US006874176B2

(12) United States Patent
Berge

(10) Patent No.: US 6,874,176 B2
(45) Date of Patent: Apr. 5, 2005

(54) MAT ASSEMBLY FOR THE PREVENTION OF BEDSORES

(76) Inventor: Trygve Berge, 0022 Cove Blvd., Dillon, CO (US) 80435

( * ) Notice: Subject to any disclaimer, the term of this patent is extended or adjusted under 35 U.S.C. 154(b) by 0 days.

(21) Appl. No.: 10/334,403

(22) Filed: Dec. 30, 2002

(65) Prior Publication Data

US 2004/0123382 A1 Jul. 1, 2004

(51) Int. Cl.[7] ..... A61G 7/14; A61G 7/10; A61G 1/013; A61G 1/048

(52) U.S. Cl. ..... 5/81.1 T; 5/81.1 R; 5/81.1 HS; 5/627; 5/925

(58) Field of Search ..... 5/81.1 R, 81.1 T, 5/81.1 C, 81.1 HS, 925, 926, 627, 625

(56) References Cited

U.S. PATENT DOCUMENTS

| | | | | | |
|---|---|---|---|---|---|
| 1,795,435 | A | | 3/1931 | Melzer | |
| 3,284,816 | A | | 11/1966 | Laubsch | 5/81 |
| 3,829,914 | A | | 8/1974 | Treat | 5/81 |
| 3,849,813 | A | | 11/1974 | Neilson | 5/334 |
| 4,051,565 | A | | 10/1977 | Berge | 5/81 |
| D277,352 | S | * | 1/1985 | Klein | D6/609 |
| 5,208,926 | A | * | 5/1993 | Stackhouse | 5/482 |
| D339,771 | S | * | 9/1993 | Newman | 5/81.1 T |
| 5,271,110 | A | * | 12/1993 | Newman | 5/81.1 R |
| D346,346 | S | | 4/1994 | Johnson et al. | D12/128 |
| 5,327,597 | A | | 7/1994 | Rothbard | 5/481 |
| 5,638,586 | A | | 6/1997 | Malin et al. | 24/587 |
| 5,638,588 | A | | 6/1997 | Jungkind | 24/68 |
| D445,286 | S | | 7/2001 | Rhyne | D6/610 |
| 6,467,106 | B1 | * | 10/2002 | Heimbrock | 5/81.1 HS |

* cited by examiner

*Primary Examiner*—Alexander Grosz
(74) *Attorney, Agent, or Firm*—Sheridan Ross P.C.

(57) ABSTRACT

A mat assembly is provided to prevent and to treat bedsores. A draw sheet is used to shift or displace the patient on the mattress of the bed. A pole attached to the draw sheet is provided for grasping by the user to uniformly shift or move the patient. A displacement mat is placed between the draw sheet and the mattress in order to facilitate shifting of the patient. A scale may be placed on the draw sheet to facilitate recordation of shifting occurring during treatment of the patient. The mattress is preferably one which has a convoluted surface with dispersed ridges and depressions which thereby present a differing profile in terms of pressure which is transmitted to the patient lying thereon.

16 Claims, 4 Drawing Sheets

MAT ASSEMBLY FOR THE PREVENTION OF BEDSORES

FIELD OF THE INVENTION

This invention relates to a mat assembly for prevention of bedsores, and more particularly, to an assembly and method for prevention of bedsores wherein pressure points from a mattress transmitted to a patient are periodically relocated by moving the patient on the mattress thereby preventing sustained pressure from acting upon a sensitized area of the patient's body.

BACKGROUND OF THE INVENTION

A patient that is bedridden for a long period of time often develops bedsores. Bedsores, also known as pressure sores or decubitus ulcers, may develop on parts of the body particularly where the bones are near the skin (for example, the hips, shoulder blades, elbows, and ankles). Treatment of a bedsore requires constant attention from medical personnel, and healing may require a long period of treatment. Bedsores are best prevented by frequent repositioning of a patient to ensure that pressure does not continue to be placed upon one particular area of the body. For those patients that have other ailments, repositioning the patient on the patient's bed can be a very time consuming and difficult task.

A number of inventions have been developed to accommodate repositioning of a bedridden patient for purposes of preventing bedsores, or to reposition the patient for transport or other purposes. U.S. Pat. No. 3,284,816 discloses the use of a supplemental sheet which underlies the patient allowing the patient to be lifted by two persons standing on opposite sides of the bed so that the patient may be shifted back to another location on the bed. For those hospital beds of the type which include transversely jointed supports by which the head portion or foot portion can be elevated or lowered, often the patient will slide or shift toward the head or foot of the bed thereby requiring repositioning. Accordingly, the invention disclosed in this reference simply allows repositioning of the patient to the desired location on the bed. The supplemental sheet includes a piece of fabric, and a pair of stiff rods which traverse the opposite sides of the sheet thereby accommodating grasping by the two persons in order to lift the patient.

U.S. Pat. No. 3,849,813 discloses a draw sheet of substantially frictionless material for use on a bed, to enable the patient to easily slide thereon. This enables the patient to change position more easily.

U.S. Pat. No. 5,327,597 discloses a mattress pad having a convoluted top surface comprising a repeating pattern of peaks and troughs. The mass of the proximate peaks combine to create an additive effect in supporting the patient's body and the depressions allow for increased air flow between the supporting proximate peaks.

While the foregoing inventions may be adequate for their intended purposes, none of the prior art references disclose an assembly wherein the patient can be selectively relocated on the bed to periodically relieve pressure points which are transmitted to specific areas of the patient's body and wherein the assembly facilitates measurable incremental movement of the patient to best effect repositioning to prevent bedsores or to allow bedsores to better heal.

SUMMARY OF THE INVENTION

In accordance with the present invention, the mat assembly and method of the present invention provides a simple yet effective assembly which may be used with any common bedding arrangement. The invention herein can be conceptualized as both a combination of elements in the assembly, but also certain sub-combinations of the invention have utility and are considered to be part of the invention disclosed herein. Specifically, a particular utility exists with respect to the draw sheet which may be used with many types of bedding arrangements to prevent development of bedsores, as well as to assist in healing of bedsores.

The assembly of the present invention has three major components, namely, a mattress, a displacement mat, and a draw sheet. Preferably, the mattress is of the type which has a plurality of spaced ridges which concentrate pressure on the patient while intervening depressions or troughs reduce pressure on the patient's body between the adjacent ridges. The displacement mat is positioned over the mattress. The draw sheet is then positioned over the displacement mat. The draw sheet includes means formed on opposite sides thereof which facilitate grasping by the user in order to shift or slide the patient on the bed. In the preferred embodiment, the draw sheet includes a pair of poles which are received through corresponding loops formed on opposite sides of the draw sheet thereby facilitating grasping by the user. In operation, a single user, or in the event the patient is particularly heavy, two users may grasp the draw sheet by one of the poles and then pull the draw sheet such that the patient shifts to a different location on the mattress. The displacement mat enables the patient to be shifted with a great reduction in friction between the mattress and the draw sheet. A scale in desired increments may be placed upon the draw sheet thereby providing the user a measurement to determine the distance in which the patient has been shifted. This scale provides a positive means by which medical staff may keep-track of the number and amount of shifting actions that have taken place to properly reposition the patient.

According to the method of the present invention, the foregoing assembly is provided and the scale or increments placed on the draw sheet provide a means to not only measure the displacement or shifting of the patient on the mattress, but also can be used to record the alignment of the patient on the draw sheet which would also affect the amount of shifting required of the patient. For example, for those patients which would be lying substantially motionless due to severe injury or other causes, periodic shifting of the patient by use of the draw sheet and then recording the amount of shift or displacement would adequately record the frequency and amount of shifting needed for the patient. For those patients which may by themselves periodically shift on the mattress, the scale placed on the draw sheet would further provide a means to measure the shift by the patient which would in turn, affect the necessary additional shifting of the patient by medical staff. If the patient was normally moving or shifting, then it may not be required to actually shift the patient by manipulating the draw sheet. On the other hand, the patient may continually reposition himself/herself to a particularly undesirable position which requires more frequent repositioning by manipulating the draw sheet.

These and other aspects and advantages of the invention will become more apparent from a review of the drawings, taken in conjunction with the detailed description.

DETAILED DESCRIPTION OF THE DRAWINGS

Figure 1:
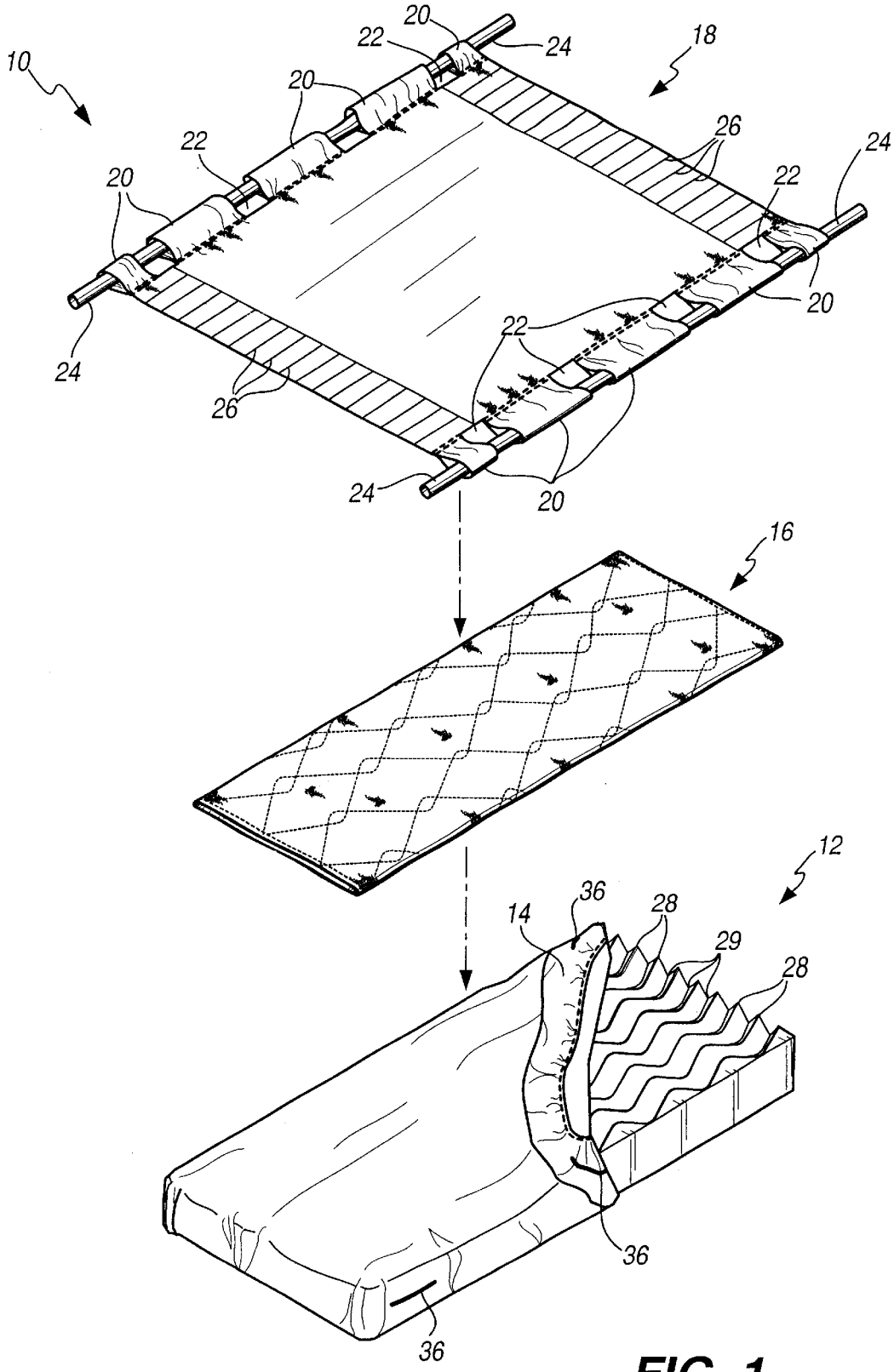
FIG. 1 is an exploded perspective view of the assembly of the present invention.

According to FIG. 1, a preferred embodiment of the mat assembly 10 of the present invention is shown. The mat assembly 10 includes three major components, namely, a mattress 12, a displacement mat 16, and a draw sheet 18. Optionally, a mattress sheet 14 may be placed over the mattress 12. Preferably, the mattress is made of a synthetic foam which includes a plurality of ridges 28 and interspersed depressions 29. This pattern of ridges and depression provides a series of contact points on a patient such that distinct pressure points are transmitted from the ridges 28 to the points of the patient's body overlying these ridges, while significantly decreased pressure is transmitted to the areas of the patient's body which overlie the depressions 29. The construction of the mattress 12 shown in FIG. 1 is one which is well known in use for bedridden patients.

Figure 4A:
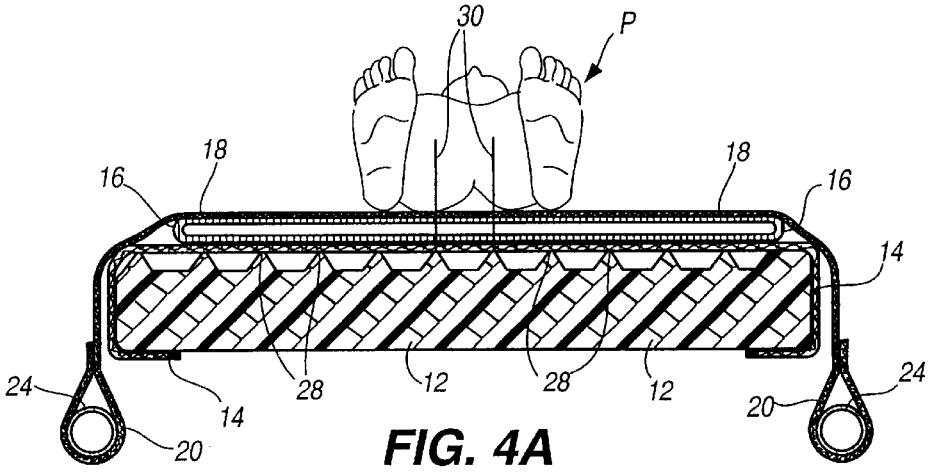
FIGS. 4A, 4B and 4C are enlarged vertical cross-sections illustrating how a patient may be repositioned by use of the assembly to alter the locations at which pressure points are transmitted to the patient.
Figure 4B:
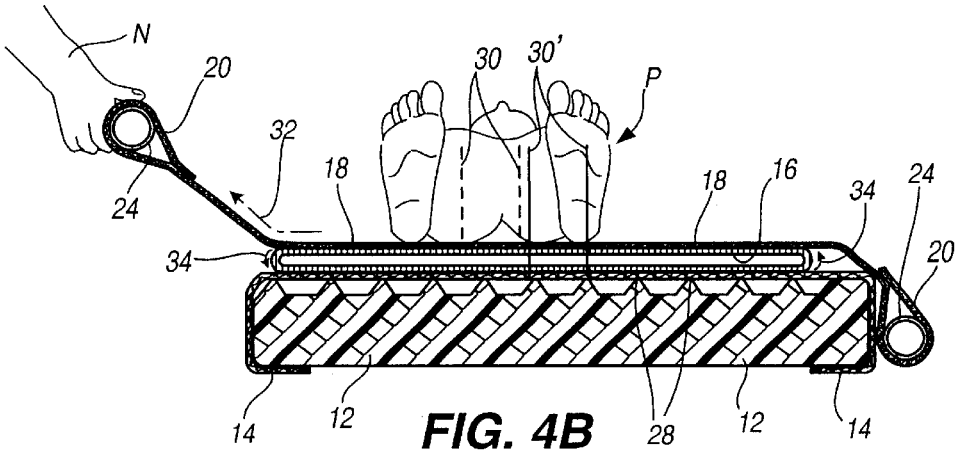
Figure 4C:
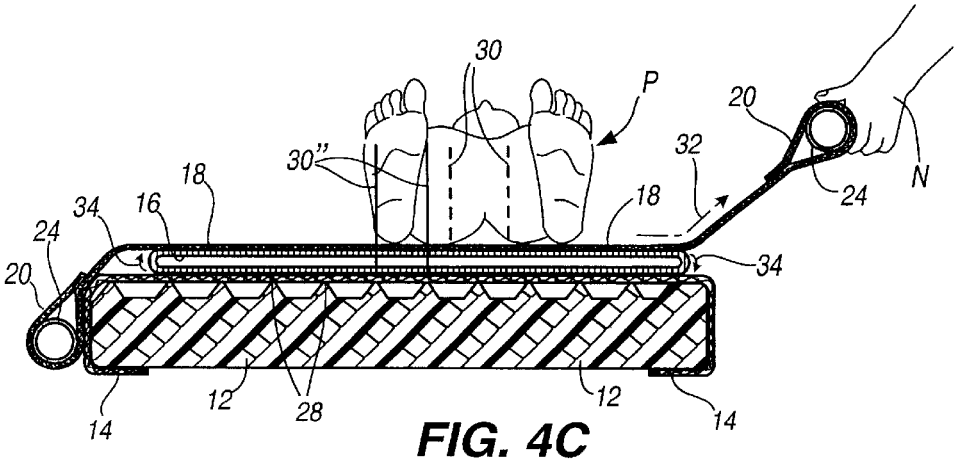

The displacement mat 16 is constructed of a fabric material which is assembled in a tubular shape. Referring to FIGS. 4A–4C, the displacement mat 16 rotates in a clockwise or counterclockwise direction depending upon the direction in which the draw sheet 18 is pulled. One commercially available device which is used to transport patients from one surface to another and may be used as the displacement mat with the present invention is the Slide Mat product manufactured by Slide-Mat, Inc. of Breckenridge, Colo. The displacement mat 16 preferably has an outer surface which is relatively coarse or roughened, thereby facilitating rolling contact with both the draw sheet 18 and the mattress sheet 14. The interior surfaces of the displacement mat 16 are preferably frictionless so that they do not bind with one another or otherwise stick to one another as they are placed in sliding contact during the rolling or rotating movement of the displacement mat. For example, the outside surfaces of the displacement mat 16 may be made of a fabric known as Avalite™. The inner surfaces may be made of a slick fabric such as ripstop nylon. Those skilled in the art can envision other appropriate fabric materials to use to facilitate the rolling or rotating motion of the displacement mat during use.

The draw sheet 18 may be a single piece of fabric with a plurality of loops 20 formed on two opposite edges or sides. The loops receive poles or rods which may then be grasped by a user. A plurality of hand openings 22 may be formed between the loops 20. In the preferred embodiment, each side of the draw sheet would include four hand openings 22. The pair of inside hand openings 22 allow a single user to shift or move a patient. If a particularly heavy patient was encountered, two persons could shift the patient by the two users each grasping a pair of adjacent hand openings 22. A scale 26 in the desired increments may be placed on one end or both ends of the draw sheet. The scale is used as a measuring device to help the user determine the extent to which the patient has been shifted, as explained further below. The scale may be printed on the draw sheet, or may be applied by any other well known means.

By use of the poles 24, the pulling action of a user is evenly distributed throughout the length of the draw sheet 18 thereby ensuring that the body of the patient is evenly and uniformly shifted. The poles 24 also prevent the draw sheet 18 from becoming bunched or folded which would otherwise inhibit the ability to shift the patient.

Figure 2:
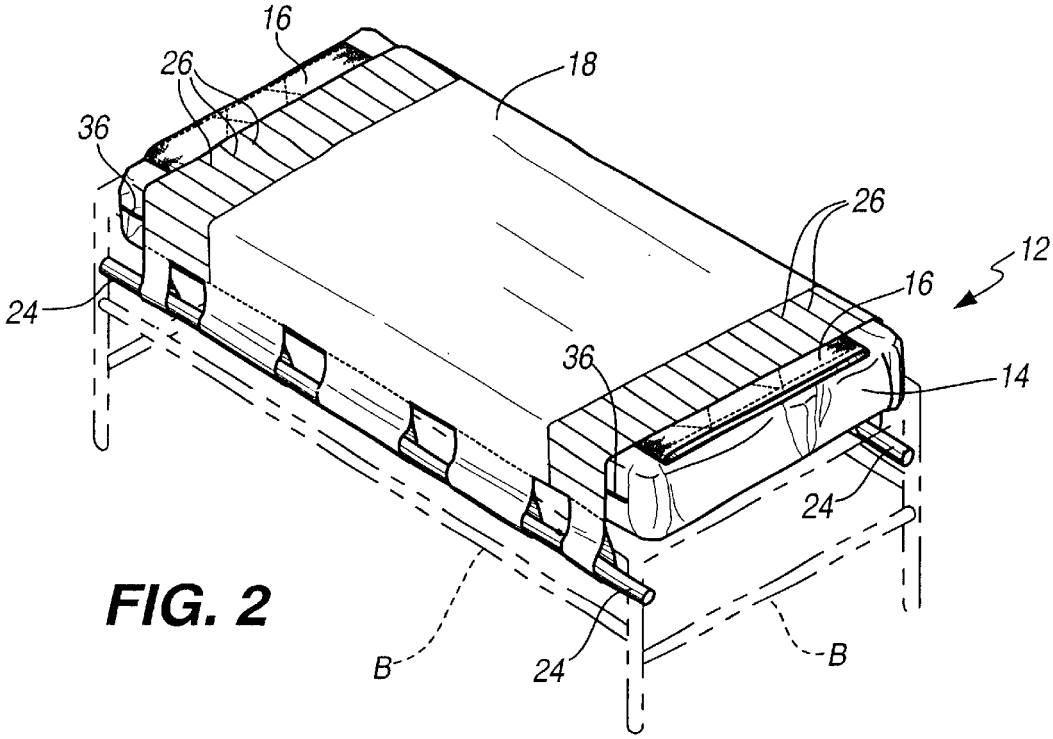
FIGS. 2 and 3 are perspective views of the assembly of the present invention installed on a standard bed.
Figure 3:
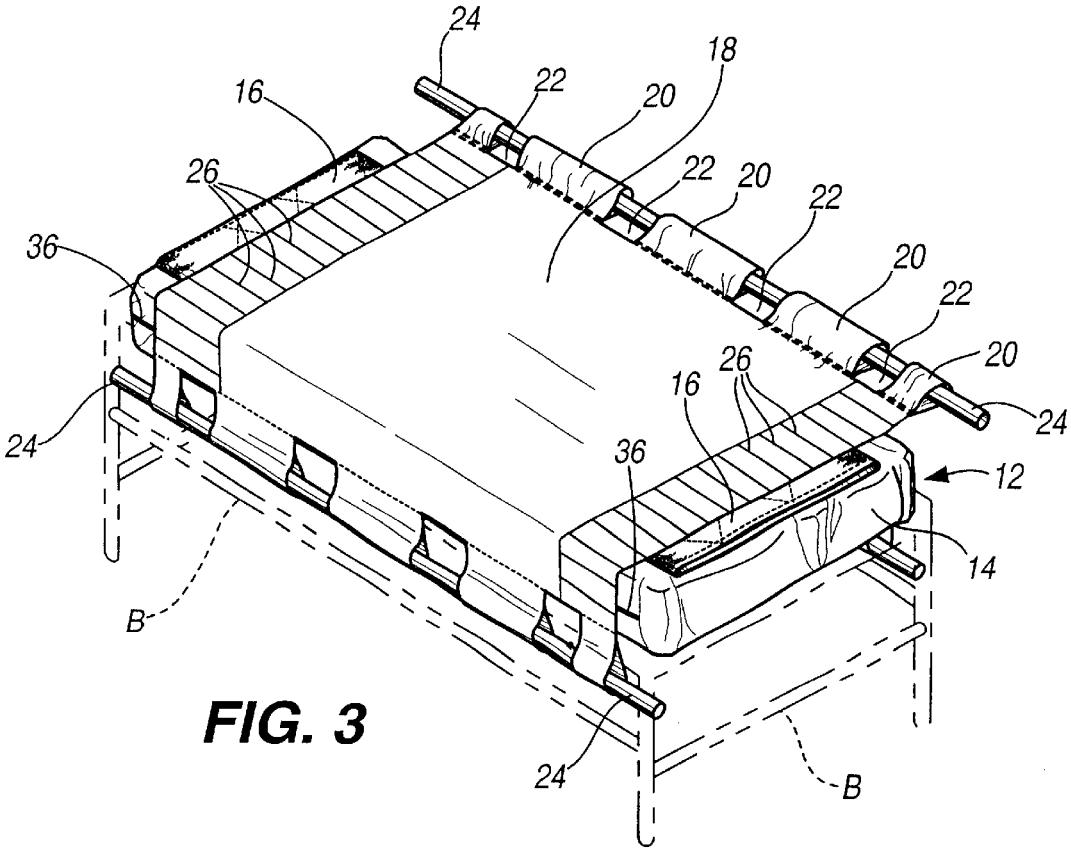

FIGS. 2 and 3 illustrate the assembly of the present invention installed on a bed B. As shown, the poles 24 may be allowed to overhang opposite sides of the bed. The draw sheet 18 may be sized so that it is shorter than the length of the mattress 12. The displacement mat 16 may also be sized so its width is less than the width of the mattress 12.

Referring to FIGS. 4A–4C, a cross-section of the assembly is shown. For purposes of illustration, the ridges 28 are not shown as being compressed by the patient P in order to better view the changing pressure points with respect to the position of the patient as the patient is shifted. Also, the displacement mat 16 is not shown in a compressed state thereby also facilitating viewing of how the displacement mat 16 rotates or rolls when the draw sheet 18 is pulled. Referring specifically to FIG. 4A, two transmission lines 30 are shown which indicate transmission of pressure points caused by two corresponding ridges 28. These transmission lines 30 are shown as intersecting two particular points on the body of the patient P. FIG. 4B illustrates a nurse N pulling the draw sheet 18 to the left in a direction shown by directional arrows 32. This pulling action causes the displacement mat 16 to rotate in a counterclockwise direction shown by directional arrows 34. The patient P is thereby shifted to the left in response to the displacement of the draw sheet 18. The transmission lines 30' in FIG. 4B transmit pressure to two new points on the patient P. The original transmission lines 30 shown in 4A are shown as dotted lines in FIG. 4B. The distance between the original transmission lines and the new transmission lines signify the amount of displacement or shift in the patient. The user may shift the patient the desired increment in order to locate the pressure points along the desired locations of the body. Under most circumstances, it will simply be required for the user to periodically shift the patient a set number of increments on the scale 26, in order to vary the pressure transmitted to the patient's body. FIG. 4C illustrates the patient being shifted back to the right in the direction shown by arrow 32, thereby causing pressure to be transmitted to two new locations on the patient's body. The new transmission lines 30" are shown in solid lines while the original transmission lines 30 of FIG. 4A are shown in dotted lines. As the patient is shifted back to the right and beyond the original location shown in FIG. 4A, the displacement mat 16 will rotate in a clockwise direction shown by arrows 34.

In order to record the increments at which a patient has been shifted, the various marks on the scale 26 may be aligned with indices either on the frame of the bed or on the mattress. For example, the attending nurse might record a particular numbered increment on the scale 26 and where that particular increment was located with respect to another marked location on the mattress, thereby registering alignment between the two points. As the attending nurse then shifted the patient according to the next prescribed shift, the attending nurse could then record the amount of shift based upon where particular increment was aligned with respect to the index. FIGS. 2 and 3 show an index line 36 on the mattress sheet 14 which may be used to help in recording the shifts. If the index line 36 is placed upon the mattress sheet 14, it would be advantageous to ensure that the mattress sheet 14 had a relatively tight fit with respect to the mattress 12 to ensure that the index line 36 itself did not inadvertently shift or move while the sheet 14 was being used. One preferred sequence for shifting or moving the patient in order to prevent bedsores might include shifting the patient in three inch increments across the mattress. Thus, the patient might be shifted three inches to the left in a first action, three additional inches to the left in a next action, nine inches to the right in a next action, then an additional three inches to the right in yet another action. As can be seen in this four step sequence, a patient will have experienced four different shifts or movements whereby the pressure points have been shifted or moved four times to different locations on the patient's body.

It shall also be understood that the draw sheet 18 might be used alone with other bedding configurations. For example, the draw sheet 18 could be used without the displacement mat 16. Additionally, the draw sheet 18 could be used with other types of mattresses which may have different characteristics in terms of how pressure is transmitted to a patient from the mattress.

Figure 5:
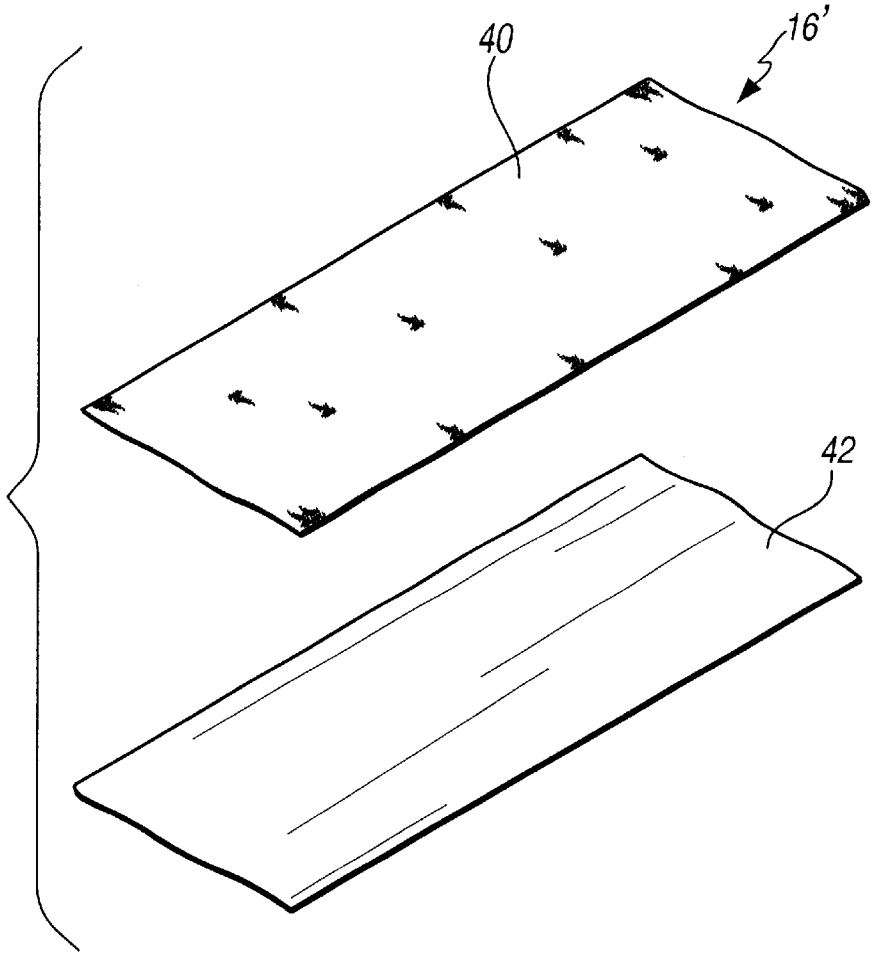
FIG. 5 is an exploded perspective view of an alternate configuration of the displacement mat shown in FIG. 1.
Figure 6:
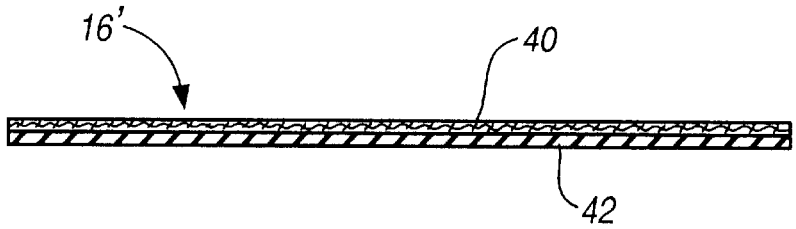
FIG. 6 is a cross-sectional view of the displacement mat of FIG. 5.

The displacement mat 16 itself could be reconfigured so that it was simply a two ply piece of material. Referring to FIGS. 5 and 6, a displacement mat 16'is shown in an alternate configuration. The mat 16'may include an upper layer 40 and a lower layer 42. The upper layer 40 would have an exposed surface having a very slick, frictionless characteristic while the bottom layer 42 would have an exposed surface having a very high friction characteristic which would prevent the matt 16'from sliding over mattress sheet 14. Thus, in comparison, the upper layer would have a lower coefficient of friction than the lower layer. The upper layer could be made of any well known low friction fabric such as rip-stop nylon. The bottom layer could be made of a sheet of rubber or a coarse fabric. Alternatively, the bottom layer could be coated with a washable but sticky substance such as an adhesive. It is also contemplated that the displacement mat 16'could simply be a single sheet or layer of material having a slick upper surface and a high friction lower surface. For example, the upper surface could be coated with a slick coating while the lower surface could be coated with a sticky coating. These coatings would be those approved for use in medical applications. In use of the displacement mat 16', the draw sheet 18 would simply slide across the upper surface of the mat. The displacement mat 16'would be maintained in a fixed position with respect to the sheet 14. Nonetheless, the displacement mat 16'in this configuration would still facilitate the movement of the draw sheet 18 by reducing friction which would otherwise make it more difficult to shift the patient.

As for the particular form of the mattress 12, it is also contemplated within the present invention that other types of mattresses may be used. Each type of mattress will have its own characteristics in terms of transmission of pressure points to the patient. Accordingly, the draw sheet 18 would still have great utility because the draw sheet provides the ability for a user to incrementally shift a patient.

While the assembly of the present invention has been shown above with respect to a particular preferred embodiment, it shall be understood that various modifications and changes may be made which fall within the spirit and scope of the present invention.

What is claimed is:

1. A mat assembly comprising:

a mattress;

a displacement mat positioned over the mattress;

a draw sheet positioned over the displacement mat, said draw sheet including hand openings formed on opposing sides of the draw sheet and said drawsheet including a scale incorporated thereon for measuring displacement of the drawsheet;

means for grasping the draw sheet, said means for grasping being of a rigid construction for uniformly transferring force from the means for grasping to the draw sheet as a user manipulates the means for grasping; and an index placed at a fixed location with respect to said mattress enabling a user to compare displacement of the drawsheet with respect to the mattress.

2. An assembly, as claimed in claim 1, further including:

a plurality of loops formed on said opposite sides of said draw sheet thereby facilitating insertion of said means for grasping therethrough.

3. An assembly, as claimed in claim 1, wherein:

said displacement mat has a tubular configuration wherein said displacement mat rotates as said draw sheet is displaced over the displacement mat.

4. An assembly, as claimed in claim 1, wherein:

said displacement mat has an upper surface in contact with a lower surface of said draw sheet, said upper surface being made of a material which minimizes friction, said displacement mat including a lower surface having a coefficient of friction which is higher than the upper surface.

5. An assembly, as claimed in claim 1, wherein:

said mattress includes a plurality of ridges separated by a corresponding plurality of depressions.

6. An assembly, as claimed in claim 1, further comprising:

a mattress sheet placed between said mattress and said displacement mat.

7. A mat assembly comprising:

a mattress;

a displacement mat positioned over the mattress;

a draw sheet positioned over the displacement mat;

said draw sheet further including a scale incorporated thereon for measuring displacement of the draw sheet with respect to the mattress; an index placed at a fixed location with respect to said mattress, enabling a user to compare displacement of the drawsheet with respect to the mattress; and means for grasping the draw sheet, said means for grasping being of a rigid constriction for uniformly transferring force from the means for grasping to the draw sheet as a user manipulates the means for grasping.

8. An assembly-as claimed in claim 7, wherein:

said draw sheet further including hand openings formed on opposing sides of the draw sheet adjacent said means for grasping.

9. An assembly, as claimed in claim 7, further including:

a plurality of loops formed on said draw sheet thereby facilitating insertion of said means for grasping therethrough.

10. An assembly, as claimed in claim 7, wherein:

said displacement mat has a tubular configuration wherein said displacement mat rotates as said draw sheet is displaced over the displacement mat.

11. An assembly, as claimed in claim 7, wherein:

said displacement mat has an upper surface in contact with a lower surface of said draw sheet, said upper surface being made of a material which minimizes friction, said displacement mat including a lower surface having a coefficient of friction which is higher than the upper surface.

12. An assembly, as claimed in claim 7, wherein:

said mattress includes a plurality of ridges separated by a corresponding plurality of depressions.

13. An assembly, as claimed in claim 7, further comprising:

a mattress sheet placed between said mattress and said displacement mat.

14. A method of preventing bedsores for a patient, said method comprising the steps of:

providing a bed including a mattress that has an index placed at a fixed location with respect thereto, a displacement means in the form of either a planar sheet of material or a tubular configuration of material and placed over the mattress, and a draw sheet having rigid grasping means disposed on opposite lateral sides of said drawsheet, said drawsheet placed over the displacement means and in contact therewith;

grasping a rigid means attached to said draw sheet;

pulling the draw sheet a desired direction by manipulation of the rigid means, said pulling step being completed by pulling substantially horizontally;

observing the amount of displacement of the draw sheet with respect to the mattress by a scale incorporated with the drawsheet to enable measurement of displacement; and subsequently pulling the draw sheet to further displace the patient when it is determined that the patient needs to be shifted to avoid prolonged pressure transmitted to particular parts of the patient's body.

15. A mat assembly comprising:

a mattress;

a displacement mat positioned over the mattress;

a draw sheet positioned over the displacement mat, said draw sheet including hand openings formed on opposing sides of the draw sheet; and means for grasping the draw sheet, said means for grasping being of a rigid construction for uniformly transferring force from the means for grasping to the draw sheet as a user manipulates the means for grasping; and said displacement mat has an upper surface in contact with a lower surface of said draw sheet, said upper surface being made of a material which minimizes friction, said displacement mat including a lower surface having a coefficient of friction which is higher than the upper surface.

16. A mat assembly comprising:

a mattress;

a displacement mat positioned over the mattress;

a draw sheet positioned over the displacement mat;

said draw sheet further including a scale incorporated thereon for measuring displacement of the draw sheet with respect to the mattress;

means for grasping the draw sheet, said means for grasping being of a rigid construction for uniformly transferring force from the means for grasping to the draw sheet as a user manipulates the means for grasping; and said displacement mat has an upper surface in contact with a lower surface of said draw sheet, said upper surface being made of a material which minimizes friction, said displacement mat including a lower surface having a coefficient of friction which is higher than the upper surface.

* * * * *